US007025531B1

(12) United States Patent
Fournier

(10) Patent No.: US 7,025,531 B1
(45) Date of Patent: Apr. 11, 2006

(54) BIDIRECTIONAL ADJUSTABLE BOAT CRADLE

(76) Inventor: Oscar A Fournier, 9134 N. Swan Cir., Brentwood, MO (US) 63144

( * ) Notice: Subject to any disclaimer, the term of this patent is extended or adjusted under 35 U.S.C. 154(b) by 0 days.

(21) Appl. No.: 10/906,411

(22) Filed: Feb. 18, 2005

(51) Int. Cl.
*B63C 1/08* (2006.01)
*B63C 1/10* (2006.01)

(52) U.S. Cl. ..... 405/7; 114/44

(58) Field of Classification Search ..... 405/1–4, 405/7; 114/44
See application file for complete search history.

(56) References Cited

U.S. PATENT DOCUMENTS 1,515,435 A * 11/1924 Glover ..... 405/7
3,379,314 A * 4/1968 Canning ..... 211/59.4
3,771,666 A * 11/1973 Fournier ..... 414/591
5,186,576 A * 2/1993 Fournier ..... 405/7
5,622,447 A 4/1997 Fournier ..... 405/7
5,888,019 A 3/1999 Quastad ..... 405/3
5,890,835 A 4/1999 Basta et al. ..... 405/3
5,908,264 A 6/1999 Hey ..... 405/3
5,919,000 A 7/1999 Unkle ..... 405/3
6,318,929 B1 11/2001 Basta ..... 405/3
6,834,604 B1 * 12/2004 O'Neil et al. ..... 114/44
6,837,651 B1 1/2005 Basta ..... 405/3

* cited by examiner

*Primary Examiner*—Meredith C. Petravick
*Assistant Examiner*—Tara L. Mayo

(57) ABSTRACT

A boat cradle has two pair of channels comprised of two lower channels supporting two upper channels. The lower channel members are each pivotally fixed to its own upright; the upper channels support a plastic pad that rotates to match the bottom and the inclination of the boat. One of the inner ends of the lower channels mounts a transfer block, and the other mounts a transfer plate. The lower channels are kept generally to a horizontal position by a leaf spring; one end bearing against the bottom of the web of the lower channels and the other end fixed to the upright post. A cut out on the upright post limits the lower pair of supports beyond the horizontal in an upward direction.

8 Claims, 9 Drawing Sheets

SECTION 3-3

BIDIRECTIONAL ADJUSTABLE BOAT CRADLE

BACKGROUND OF THE INVENTION

This invention relates to a boat cradle capable of adjusting in two directions perpendicular to each other. In my earlier U.S. Pat. No. 5,622,447 issued Apr. 22, 1997 adjustment was capable in only one direction: To the dead-rise of the boat. This invention is intended particularly for supporting long High Performance boats requiring adjustment in two directions. Boat cradles of the prior art do not provide adjustment if the boat is inclined at an angle describing a horizontal plane not parallel to the ground. The new invention, with its capabilities for aligning itself to the angle the boat makes with respect the floor, prevents the boat from resting on the edge of the cradle pad or supporting structure. Hence it eliminates the high stress concentration potentially damaging the hull as it contacts the edge of the cradle pad. This cradle invention is capable of adjusting to the degree of inclination fore and aft of up to 3 degrees plus to the dead-rise of the hull.

SUMMARY OF THE INVENTION

The invention further resides on the interface of two channel shaped pair of sheet metal members opposing each other. Each pair is developed to perform a distinct function: the upper pair has the capabilities to tilt 3 degrees, and the lower pair does not. The primary function of the lower channels is to align the system to match the dead-rise of the hull; the upper channels to align/adjust to the longitudinal angle of the boat. Each of the two lower channels is connected by means of a shaft extending the length of the upper channels supported by bearings on the lower channels to transfer the load from the upper channels to the lower channels. Additional bearing tubes are structurally positioned in the lower channels provide further support to the shaft.

The rotation center for the lower channels is a tube shaft of ample wall thickness and diameter to eliminate the need for additional bearing supports between this tube and the lower channel to reduce the pressure in bearing to the upright supports. Of note is that both right and left lower channels deflect the same degree regardless of which side of the cradle the boat touches first. To accomplish this a transfer block located at the inner end of the left lower channel, comprised of two plates parallel and facing each other forming a locus of points describing a curve that a pin welded to a plate bolted to the inside end of the right lower channel, will follow. These two transfer blocks at the inner ends of both lower channels have advantages unequaled by any prior art because the inner ends of the lower channels are not weakened at the flanges by the necessary cut-out to transfer equal angularity from one side to the other.

The foregoing and other advantages of the invention will appear in the following detailed description. In the description referenced is made to the accompanying drawings to illustrate the features of the new invention.

DETAILED DESCRIPTION

Figure 1:
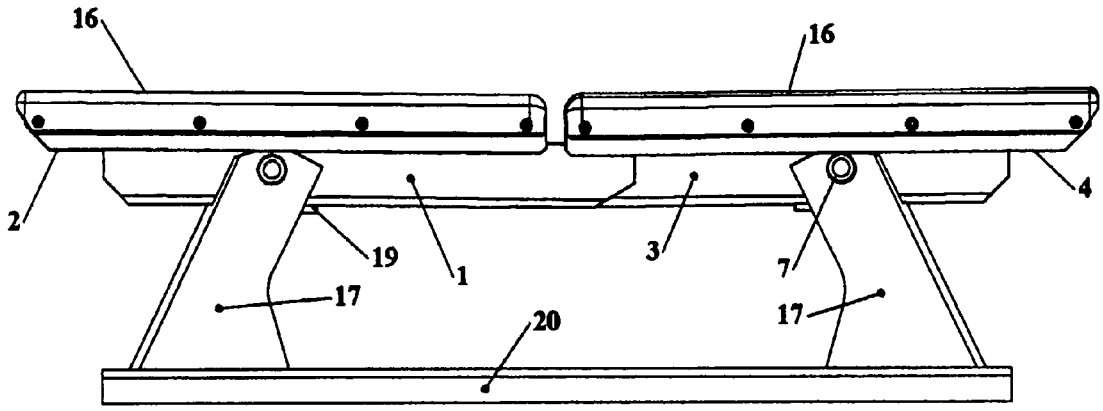
FIG. 1 this is a front view in elevation of the invention
Figure 2:
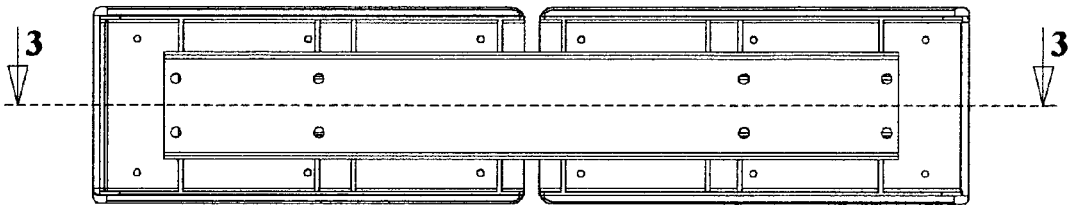
FIG. 2 is a bottom view of FIG. 1
Figure 3:
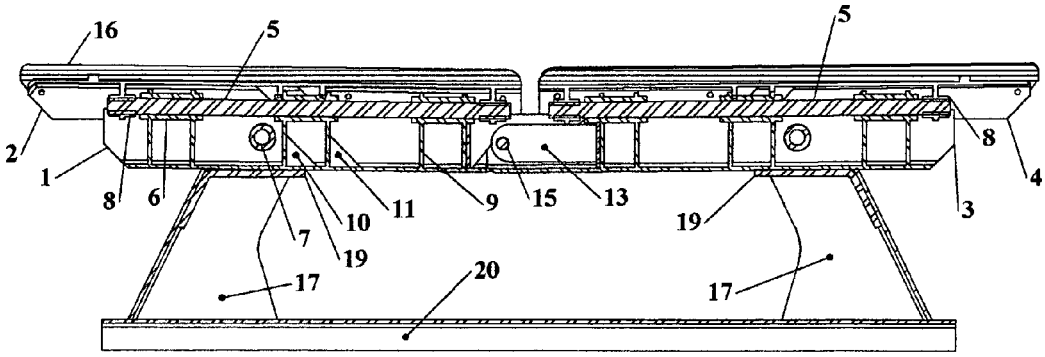
FIG. 3 is a longitudinal cross section taken in the plane A—A of FIG. 2
Figure 4:
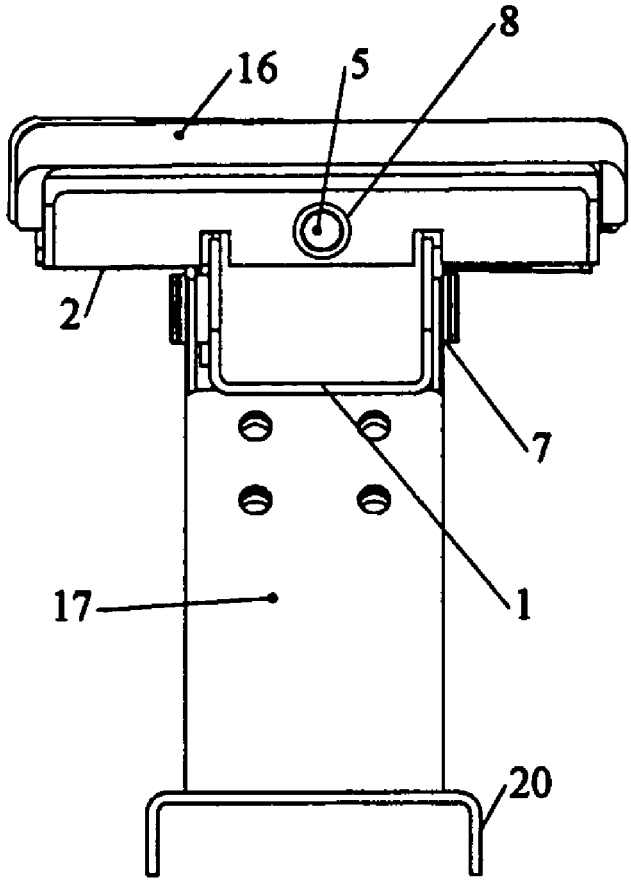
FIG. 4 left end view of FIG. 1
Figure 5:
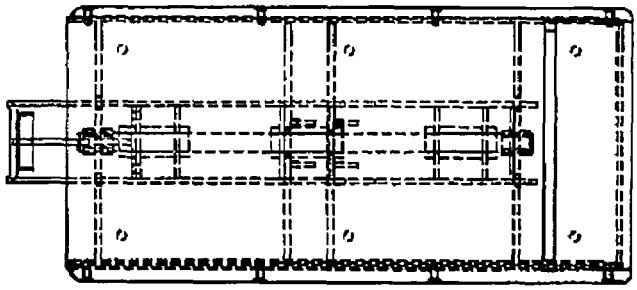
FIG. 5 left end view of FIG. 1 with the top channel rotated 3 degrees
Figure 5:
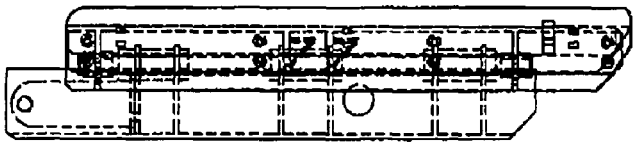
Figure 5:
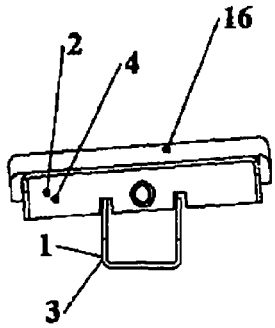
Figure 6:
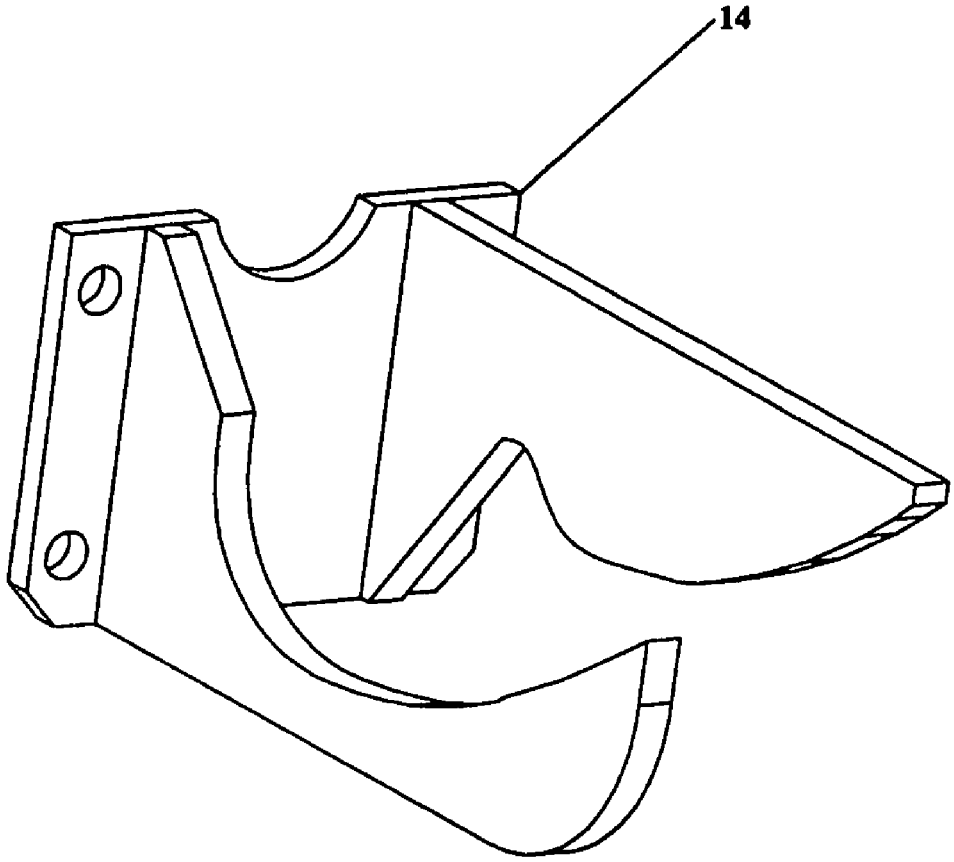
FIG. 6 is the left transfer block assembly
Figure 7:
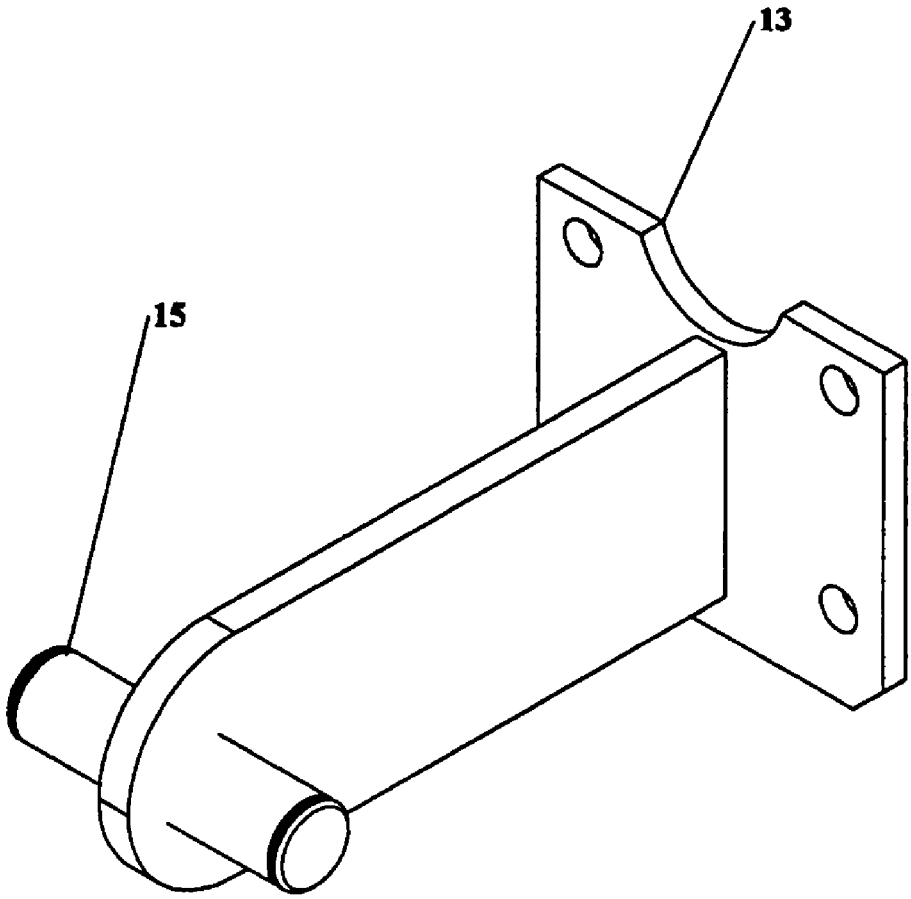
FIG. 7 is the right transfer block assembly
Figure 8:
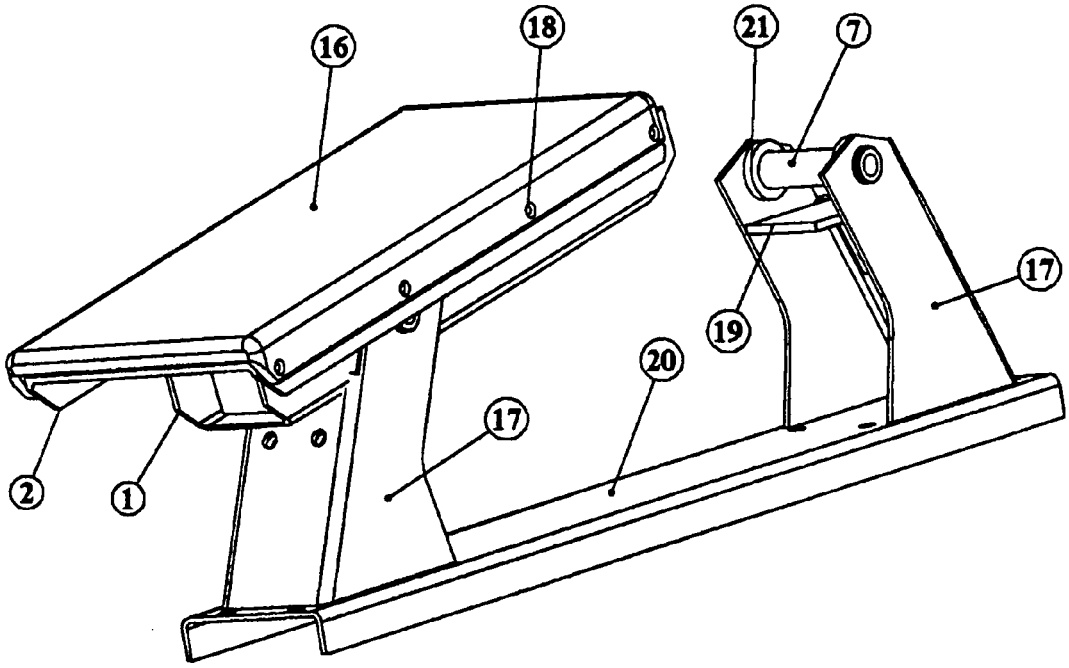
FIG. 8 is a view showing the leaf spring and filler washer details

The cradle includes a pair of channel shaped uprights-17 that are welded to a common base-20. As seen in FIG. 1, the uprights-17 are inclined from the vertical and facing towards each other. The base of these uprights is wide enough to include the vertical component acting on the rotating pin-7 to prevent any overturning moment. Looking at FIG. 1, a pair of lower channels 1 & 3 support two upper channels 2 & 4. The lower and upper channels are joined together by means of a long shaft-5 see FIG. 3, extending approximately the entire length of the channels supported by structural tubes-6, see FIG. 3 on the lower channels, and by tubes/bearings-8 located on the outer ends of upper channels. Reinforcing ribs-9, see FIG. 3, are welded to the inside of the of the flanges of the lower channel and to the bottom of the structural tubes-6 to transfer the load to the webs and flanges of the lower channels. Ribs-10 & 11, see FIG. 3, welded to the inside of the webs of the upper and lower channels respectively have the function of reacting against the horizontal component produced by the weight of the boat as it slides down on the pad-16. The long shaft-5 serves as the center of rotation for up to 3 degrees in either direction with respect to the lower channels. The upper channels are covered by a polyurethane-16 or equal, pads screwed with flat-head screws-18 to the outer flanges of the upper channels. Dimensionally, the lower channel-1 is wider than lower channel-3 to permit the latter to function inside of the lower channel-1 as both channels 1 & 3 rotate about rotating tube 7. A plastic washer-21 see FIG. 8—between the outside of the upright and the inside of the of the lower right channel-3 is used to compensate for this difference in web dimension of the two lower channels 1 & 3 The transfer of the angle created by the rotational deflection between the lower channels 1 & 4 is produced by a block-14 (see FIG. 5) located at the inner end of the left lower channel consisting of two plates welded to a common plate and bolted to the inner most rib of lower channel-1. These two plates are welded parallel to each other, with the lower edge of one plate facing the upper end of the other; both of these edges containing a locus of points describing a curve that will be followed by another transfer block-13 bolted to the innermost rib of the opposite lower channel-3 consisting of a central plate and pin acting between the parallel plates of transfer block-14 and pin-15. See FIG. 1 & FIG. 6

Figure 9:
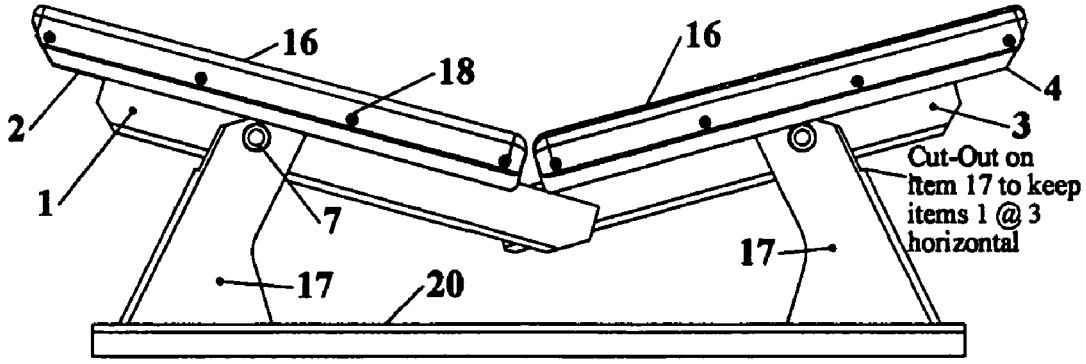
FIG. 9 is a front elevation similar to FIG. 1 adjusted to a dead-rise equal to 12 degrees
Figure 10:
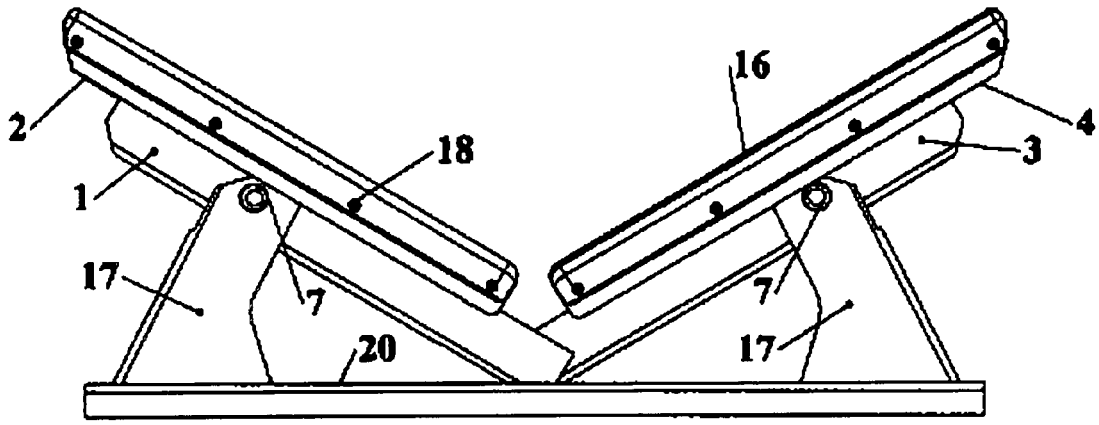
FIG. 10 is a front elevation similar to FIG. 9 showing the cradle in its lower-most position

A leaf spring is disposed beneath channels 1 & 3 bolted to the outside web of the up-rights-17. On FIG. 9 note a cu-out on the web of upright-17 that keeps channels 1 & 3 horizontal during their rotation about rotating tube-7. This cut-out precludes these two channels from continuing on an upward direction as the springs spends its energy, thus keeping the cradle on a horizontal plane when the load is removed.

The invention claimed is:

1. A cradle for storing a watercraft, said cradle comprising:

(a) a pair of elongate lower channel members, each said lower channel member being positioned substantially horizontally, having a generally upright U-shape and being pivotally mounted to a respective upright such that said lower channel members are capable of rotating about a horizontal axis; wherein said lower channel members are disposed end-to-end and have at their inner ends two transfer blocks for translating the same angular degree of movement from one said lower channel member to the other of said lower channel members regardless of which side of the cradle a watercraft touches first upon positioning;

(b) a pair of elongate upper channel members, each said upper channel member being positioned substantially horizontally above one of said lower channel members and having a generally inverted U-shape; wherein said upper channel members are disposed end-to-end; further including means for rotating said upper channel members clockwise or counterclockwise such that the longitudinal centerline of a watercraft is capable of rotating about the vertical axis; and (c) further including means for urging said lower channel members to the generally horizontal position, wherein said urging means is configured to be positioned against the bottom surface of said lower channel members.

2. A cradle for storing a watercraft, in accordance with claim 1 wherein said upper channel members have a bearing at each of their respective inner and outer ends.

3. A cradle for storing watercraft in accordance with claim 2 wherein said channel members are covered with an inverted U-shape pad disposed to the sides of said upper channel members.

4. A cradle for storing a watercraft in accordance with claim 1 wherein said lower channel members are disposed with bearings mounted to reinforcing ribs positioned on the inside of said lower channel members; and further including a shaft, wherein said bearings and said shaft are adapted to permit rotation of said upper channel members relative to said lower channel members.

5. A cradle for storing a watercraft in accordance with claim 4 further comprising bearings mounted on each outer end of said upper channels.

6. A cradle for storing a watercraft in accordance with claim 1 wherein a first said transfer block is mounted to the inner end of one of said lower channel members; said first transfer block comprising two plates with curves inside edges containing a locus of points.

7. A cradle for storing a watercraft in accordance with claim 6 wherein a second said transfer block comprises a plate to which a pin is mounted transversely, wherein said pin is in slidable contact with said locus of points of said first transfer block.

8. A cradle for storing a watercraft in accordance with claim 1, said urging means comprising at least one flat spring, wherein one end of said spring contacts one end of said lower channel members and the other end of said spring contacts one of said uprights, wherein said spring urges said lower channel member to a generally horizontal position.

* * * * *